US009408767B2

(12) United States Patent
Atalay et al.

(10) Patent No.: US 9,408,767 B2
(45) Date of Patent: Aug. 9, 2016

(54) SURGICAL OPERATING TABLE

(71) Applicant: YEDITEPE UNIVERSITESI, Istanbul (TR)

(72) Inventors: Basar Atalay, Istanbul (TR); Cem Tutcu, Istanbul (TR); Onur Deryahanoglu, Istanbul (TR)

(73) Assignee: YEDITEPE UNIVERSITESI, Istanbul (TR)

( * ) Notice: Subject to any disclaimer, the term of this patent is extended or adjusted under 35 U.S.C. 154(b) by 0 days.

(21) Appl. No.: 14/443,651

(22) PCT Filed: Nov. 14, 2013

(86) PCT No.: PCT/IB2013/002537

§ 371 (c)(1),
(2) Date: May 18, 2015

(87) PCT Pub. No.: WO2014/076546

PCT Pub. Date: May 22, 2014

(65) Prior Publication Data

US 2015/0265483 A1 Sep. 24, 2015

(30) Foreign Application Priority Data

Nov. 16, 2012 (TR) ..... a2012/13288

(51) Int. Cl.

| | |
|---|---|
| ***A47B 7/02*** | (2006.01) |
| ***A61G 13/00*** | (2006.01) |
| ***A61G 13/12*** | (2006.01) |
| ***A61G 13/08*** | (2006.01) |
| *A61G 13/02* | (2006.01) |
| *A61G 13/04* | (2006.01) |

(52) U.S. Cl.

CPC ..... *A61G 13/0036* (2013.01); *A61G 13/08* (2013.01); *A61G 13/122* (2013.01); *A61G 13/02* (2013.01); *A61G 13/04* (2013.01); *A61G 2013/0054* (2013.01)

(58) Field of Classification Search

CPC . A61G 13/0036; A61G 13/08; A61G 13/122; A61G 13/02; A61G 13/04; A61G 13/06; A61G 13/0054; A61G 2013/0054

See application file for complete search history.

(56) References Cited

U.S. PATENT DOCUMENTS

| | | | |
|---|---|---|---|
| 5,131,106 | A | 7/1992 | Jackson |
| 5,239,716 | A | 8/1993 | Fisk |
| 5,584,302 | A | 12/1996 | Sillaway et al. |
| 6,076,525 | A | 6/2000 | Hoffman |
| 6,154,901 | A | 12/2000 | Carr |
| 7,587,770 | B1 | 9/2009 | Reser |

FOREIGN PATENT DOCUMENTS

| | | | |
|---|---|---|---|
| EP | 0389188 | A2 | 9/1990 |
| GB | 2466563 | A | 6/2010 |
| WO | WO0044329 | A1 | 8/2000 |

OTHER PUBLICATIONS

Wilson Plus: "Mizuhosi 2009 1 NW0557 Rev. C", Jan. 1, 2010, XP055112067.

*Primary Examiner* — David E Sosnowski
*Assistant Examiner* — Morgan McClure
(74) *Attorney, Agent, or Firm* — Gokalp Bayramoglu

(57) ABSTRACT

The present invention relates to a lightweight and durable surgery table (1), which particularly facilitates performing spinal surgical operations, is transparent to radiographic rays and can be adjusted according to the position of the patient.

8 Claims, 4 Drawing Sheets

SURGICAL OPERATING TABLE

FIELD OF THE INVENTION

The present invention relates to a surgery table which enables to perform spine and spinal cord surgeries conveniently as well as surgeries in prone position.

BACKGROUND OF THE INVENTION

The spinal cord is a component of the central nervous system located within the spine structure that is formed by the vertebrae. The structure of the spinal cord includes white matter containing myelinated nerve cells and gray matter containing nerve cell bodies and unmyelinated nerve cells.

The spine, which has to adapt to a wide variety of movements due to the nature of the human body, may catch various diseases from these movements due to bacterial and/or virus-borne pathogens. A part of these diseases can be healed by drug therapy; however a part thereof requires surgical operation. Operation of this structure, which starts from the brain and extends to the coccyx and accommodates the nerves therein, should be performed very meticulously; otherwise, since regeneration of damaged nerves is not possible, permanent disabilities may occur. Performing the operation precisely depends on the competence and carefulness of the doctor and the adequacy and quality of the equipments s/he uses. In the spine surgeries, it is important that the patient is positioned so as to allow the doctor to easily reach the part that s/he will operate.

In the state of the, there are surgery tables Which enable to keep the patient in the suitable position; however these tables are not useful because they are heavy difficult to be adjusted according to the patients body and expensive because carbon fiber is used for them to be radio-opaque.

United States Patent document no U.S. Pat. No. 5,131,106, an application known in the state of the art, discloses a type of spinal surgery table.

United States Patent document no U.S. Pat. No. 6,154,901, an application known in the state of the art, discloses a spinal surgery table.

United States Patent document no U.S. Pat. No. 5,239,716, an application known in the state of the art, discloses a surgery table with a spinal positioning frame mounted thereon.

International patent document no. WO0044329, an application known in the state of the art, discloses a surgery table designed for operating a patient in prone position and for using in spinal surgical operations.

European Patent document no. EP0389188, an application known in the state of the art discloses an adjustable patient support which is particularly useful in spinal surgery.

SUMMARY OF THE INVENTION

An objective of the present invention is to provide a surgery table which facilitates performing spinal operations.

Another objective of the present invention is to provide a surgery table which is transparent to radiographic rays.

A further objective of the present invention is to provide a surgery table which can be adjusted according to the position of the patient.

Another objective of the present invention is to provide a lightweight and durable surgery table.

BRIEF DESCRIPTION OF THE DRAWINGS

The surgery table developed to fulfill the objectives of the present invention is illustrated in the accompanying figures, in which.

DETAILED DESCRIPTION OF THE INVENTION

Figure 1:
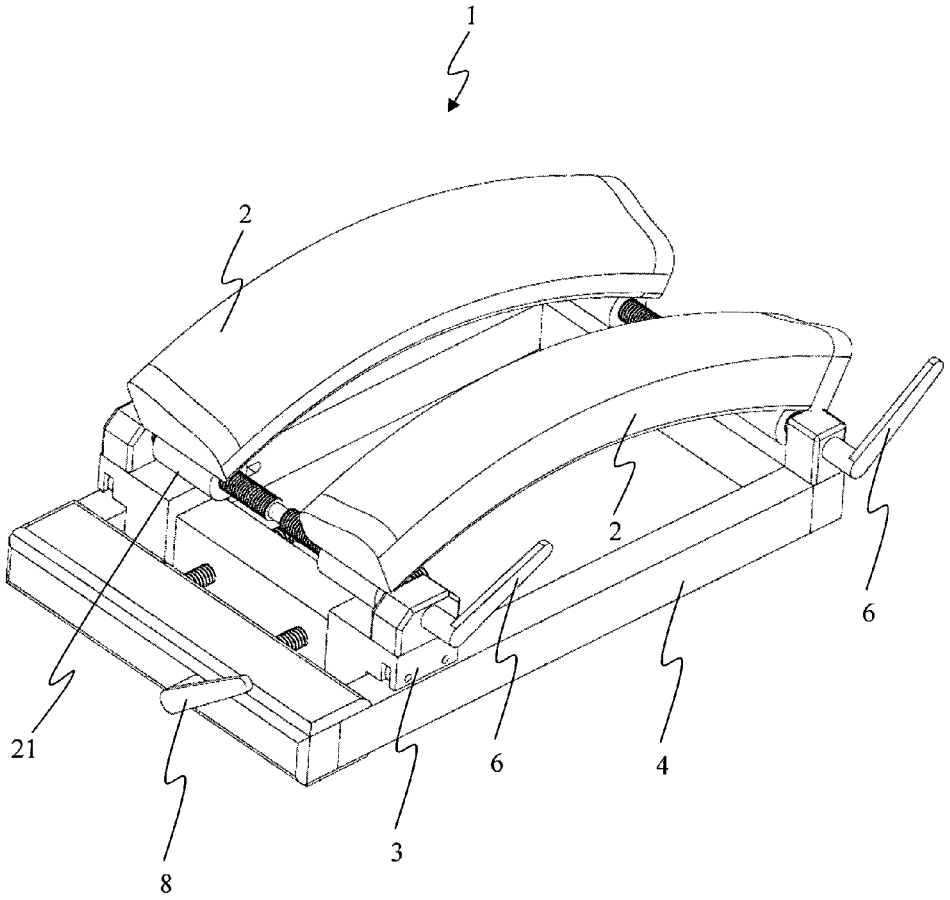
FIG. 1 is the perspective view of the inventive surgery table.
Figure 2:
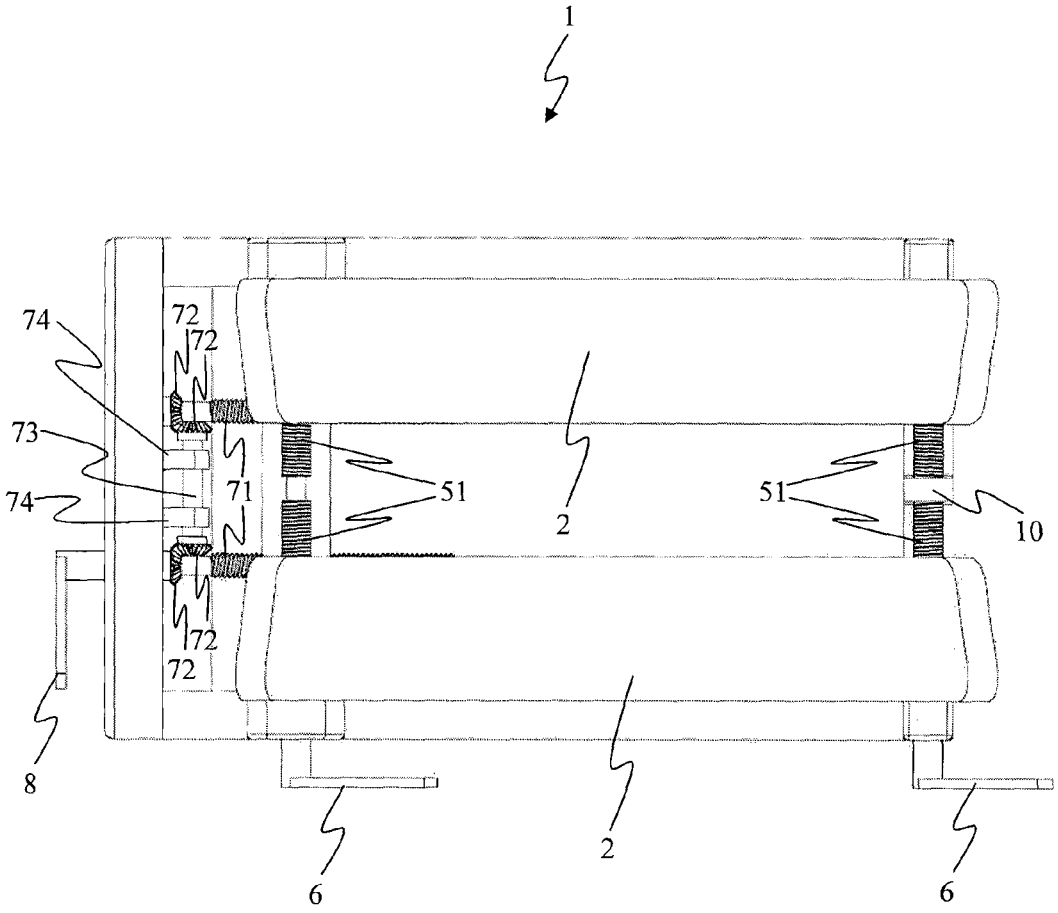
FIG. 2 is the top view of the inventive surgery table.
Figure 3:
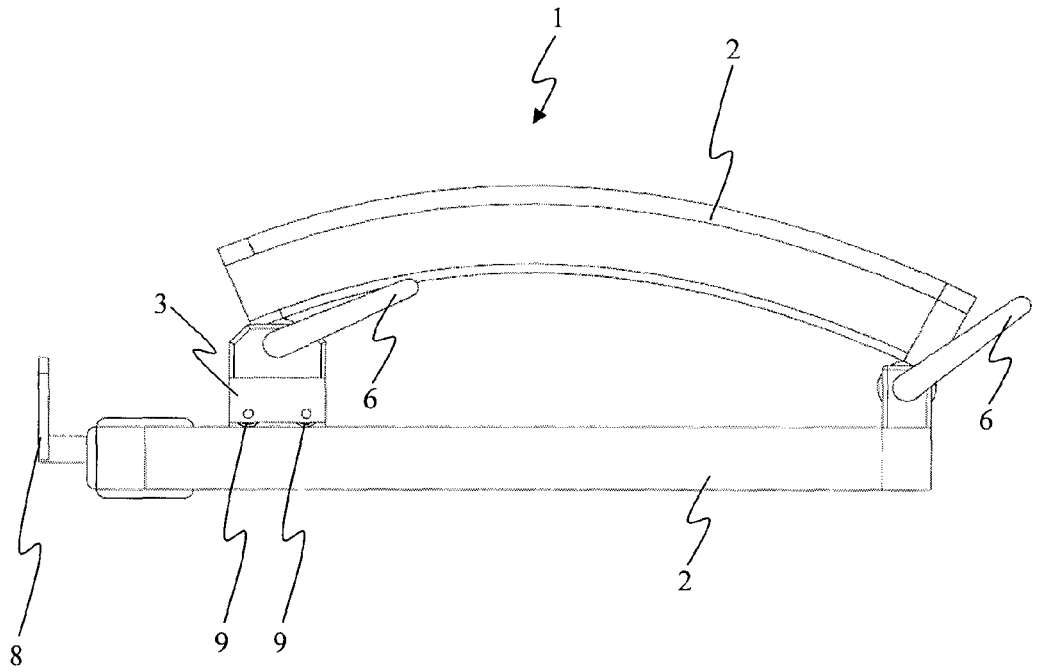
FIG. 3 is the side view of the inventive surgery table.
Figure 4:
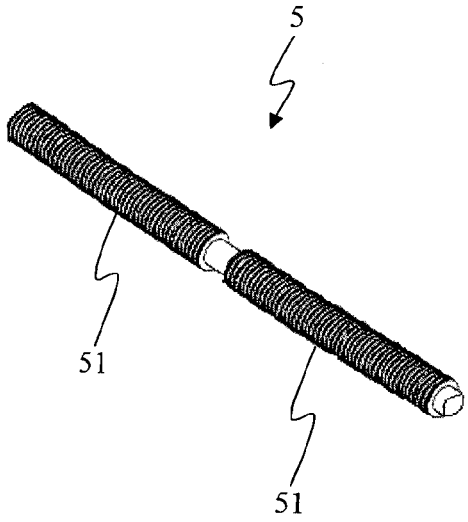
FIG. 4 is the perspective view of the spacer.
Figure 5:
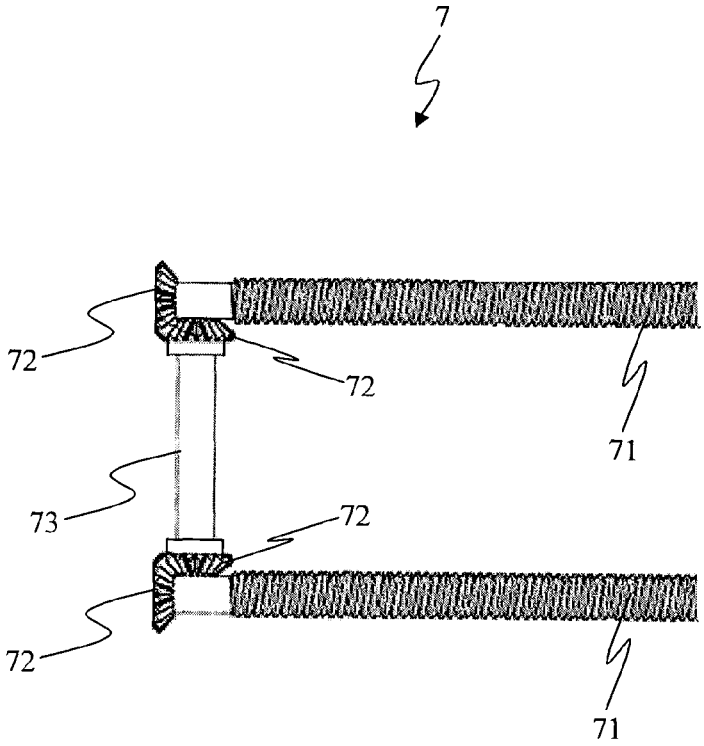
FIG. 5 is the top view of the extender.

The components shown in the figures are assigned reference numbers as follows:

1. Surgery table
2. Carrier
21. Transmission part
3. Moveable part
4. Body
5. Spacer
51. Worm gear
6. Spacer lever
7. Extender
71. Worm gear
72. Bevel gear
73. Shall
74. Bearing
8. Extender lever
9. Wheel
10. Support The surgery table (1) of the present invention basically comprises

- at least two carriers (2), on which the patient lies down, and each of which includes at least one transmission part (21) thereon for power transmission,
- at least one moveable part (3) to which one side of the carrier (2) is connected and which, by moving, enables elongation and shortening of the carrier (2),
- at least one body (4) to which the side of the carrier (2) that is not connected to the moveable pail (3) is connected, and on which the moveable part (3) can move,
- at least two spacers (5), which enable to change the distance between the carriers (2), comprise at least one worm gear (51) that enables power transmission to the transmission parts (21) of the carriers (2) and which are preferably provided such that there will be at least one spacer at the side where the carriers (2) are connected to the body (4 and at least one spacer at the side where the carriers (2) are connected to the moveable part (3),
- at least two spacer levers (6) which enable the spacers (5) to be controlled by the user,
- at least one extender (7); which enables the carriers (2) to be elongated and shortened by moving the moveable part (3); and which comprises at least two worm gears (71), which are preferably close to the two sides of the moveable part (3) in order to move the moveable part (3) properly and each of which includes a bevel gear (72) on the end thereof; a shaft (73) which enables these worm gears (71) to transmit power to each other and which includes bevel gears (72) on both ends thereof that correspond to the bevels gears (72) located at the ends of the worm gears (71); and at least one bearing (74) which enables the shaft (73) to remain fixed during rotation,
- at least one extender lever (8) which enables the extender (7) to be controlled by the user.

In the preferred embodiment of the invention, the inventive surgery table (1) comprises at least two carriers (2) on which the patient lies down. One side of each of the said carriers (2) is connected to the moveable part (3) by means of the transmission part (21). Movement of the moveable part (3) enables elongation and shortening of these carriers (2). Additionally; movement of the moveable part (3) enables to increase or decrease the radius of the arc of circumference formed by these carriers (2). This way the patient can be positioned suitably for the surgery. The other side of the carrier (2) is connected again via the transmission part (21) to the worm gear (51) of the spacer (5) located on the body (4). Besides, the moveable part (3) can move on this body (4) in the direction that the carriers (2) extend. It should be possible to adjust the distance between the carriers (2) in order to adjust the position of the patient. For this purpose, there are provided at least two spacers (which enable to change the distance between the carriers (2) on the parts of the body (4) where each end of the carriers (2) is located. There is a worm gear (51) provided on the spacer (5) for changing the distance between the carriers (2). The grooves, which are provided on the parts of these worn gears (51) that are below each carrier (are opposite to each other so as to enable the carriers (2) to move towards or away from each other. These worm gears (51) are connected to the carriers (2) via the transmission part (21) of the carriers (2). This transmission part (21) has a hollow through which the spacer (5) can pass. This hollow includes threads that correspond to the threads of the worm gear (51). The user controls each spacer (5) by means of the spacer lever (6) thereof. Elongation and shortening of the carriers (2) is enabled by the movement of the moveable part (3). When the user rotates the extender lever (8), this rotational movement is transferred to the worm gear (71) having, a bevel gear (72) at the end thereof. This rotational movement elongates or shortens the carrier (2) which is in contact with the worm gear (71). In order to elongate or shorten the other carrier (2) the same way, this rotational movement should be transferred to the other worm gear (71). The shaft (73), having a bevel gear (72) on each end thereof, is positioned between the worm gears (71) that are in contact with both of the carriers(2). The shaft (73) is positioned such that the bevel gears (72) provided at the ends thereof contact the bevel gears (72) provided at the ends of the worm gears (71). This way, the force applied by the extender level (8) is transferred to both worm gears (71) and thus both of the carriers (2) are enabled to be elongated and shortened at the same time.

In one embodiment of the invention, the moveable part (3) has at least one wheel which facilitates its movement on the body (4).

In one embodiment of the invention, there is a support (10) provided on the body (4) for supporting the worm gear (51).

In the preferred embodiment of the invention, all of the parts are made of plastic material. This way, the surgery table (1) is sturdy and radio-opaque.

It is possible to develop various embodiments of the surgery table (1) of the present invention. The invention cannot be limited to the examples described herein and it is essentially as defined in the claims.

The invention claimed is:

1. A surgery table comprising: at least two carriers, on which the patient lies down, wherein each of the carriers includes at least one transmission part thereon for power transmission; at least one moveable part to which one side of the carriers are connected and which, by moving, enables elongation and shortening of the carrier;

at least one body to which the side of the carriers that are not connected to the moveable part is connected and on which the moveable part can move;

at least two spacers which enable changing of the distance between the carriers, wherein the spacers comprise at least one spacer worm gear that enables power transmission to a plurality of transmission parts of the carriers, and wherein at least one spacer is proximate to the side where the carriers are connected to the body and at least one spacer is proximate to the side where the carriers are connected to the moveable part;

at least two spacer levers which enable the spacers to be controlled by a user;

at least one extender which enables the carriers to be elongated and shortened by moving the moveable part; wherein the at least one extender comprises at least two extender worm gears which are proximate to two sides of the moveable part in order to move the moveable part properly;

wherein the at least one extender includes a bevel gear on the end thereof, a shaft which enables the at least two extender worm gears to transmit power to each other and includes a plurality of bevel gears on both ends thereof that correspond to the bevel gears located at the ends of the at least two extender worm gears;

wherein the at least one extender includes at least one bearing which enables the shaft to remain fixed during rotation;

at least one extender lever which enables the at least one extender to be controlled by the user.

2. The surgery table according to claim 1, wherein the moveable part has at least one wheel which facilitates the movement of the moveable part on the body.

3. The surgery table according to claim 1, wherein the body includes a support thereon for supporting the at least one spacer worm gear.

4. The surgery table according to claim 1, wherein the surgery table is made only of plastic material.

5. The surgery table according to claim 2, wherein the body includes a support thereon for supporting the at least one spacer worm gear.

6. The surgery table according to claim 2, wherein the surgery table is made only of plastic material.

7. The surgery table according to claim 3, wherein the surgery table is made only of plastic material.

8. The surgery table according to claim 5, wherein the surgery table is made only of plastic material.

* * * * *